US006657140B2

(12) United States Patent
Rantet

(10) Patent No.: US 6,657,140 B2
(45) Date of Patent: Dec. 2, 2003

(54) SYSTEM FOR CONTROLLING A WINDOW OPERATOR

(75) Inventor: Dominique Rantet, Beaumont sur Leze (FR)

(73) Assignee: Siemens VDO Automotive, Toulouse Cedex (FR)

( * ) Notice: Subject to any disclaimer, the term of this patent is extended or adjusted under 35 U.S.C. 154(b) by 0 days.

(21) Appl. No.: 10/234,390

(22) Filed: Sep. 5, 2002

(65) Prior Publication Data

US 2003/0047430 A1 Mar. 13, 2003

(30) Foreign Application Priority Data

Sep. 7, 2001 (FR) ..... 01 11580

(51) Int. Cl.[7] ..... H01H 13/70
(52) U.S. Cl. ..... 200/5 R; 200/52 R
(58) Field of Search ..... 338/179, 154, 338/69, 89; 200/5 R, 1 R, 5 A; 307/10.1, 9.1

(56) References Cited

U.S. PATENT DOCUMENTS 3,997,863 A * 12/1976 Luce ..... 338/69
4,257,305 A * 3/1981 Friend et al. ..... 84/690
4,308,439 A 12/1981 Itoh
4,975,547 A * 12/1990 Nakayama et al. ..... 200/5 R
4,978,939 A * 12/1990 Zeitvogel ..... 338/176
5,329,163 A * 7/1994 Satoh et al. ..... 307/10.1
5,448,028 A * 9/1995 Filion et al. ..... 200/52 R
5,554,965 A * 9/1996 Sundberg ..... 338/160
5,601,183 A 2/1997 Boyd et al.
5,631,623 A * 5/1997 Yoshimura ..... 338/142
5,783,785 A 7/1998 Furukawa
5,945,646 A * 8/1999 Miller et al. ..... 200/5 R
5,952,630 A 9/1999 Filion et al.

FOREIGN PATENT DOCUMENTS

WO 89/01232 2/1989

* cited by examiner

*Primary Examiner*—Elvin Enad
*Assistant Examiner*—M. Fishman
(74) *Attorney, Agent, or Firm*—Young & Thompson

(57) ABSTRACT

This system includes a control part (6) permitting controlling the opening and closing of an associated window, having three separate control zones (F, M, O). In the automatic mode, when the corresponding window has been entirely opened or closed, a push on a predetermined control zone advantageously controls the movement of the window into the position in which it was before its complete opening or closing.

12 Claims, 2 Drawing Sheets

SYSTEM FOR CONTROLLING A WINDOW OPERATOR

FIELD OF THE INVENTION

The present invention relates to a system for controlling a window operator. It relates on the one hand to a control device for a widow operator and on the other hand to a process for controlling a window operator. The invention relates solely to electric window operators.

BACKGROUND OF THE INVENTION

Systems for controlling window operators known at present comprise a mechanism adapted to raise and lower a window as well as an electric motor driving this mechanism. The electric motor is controlled by a rocking button having two positions. This rocking button controls the window operator in the manual mode and in the automatic mode. In the manual mode, a pressure is maintained on the rocking button, in one or the other of the positions which it can take, until the desired position of the window is achieved.

In the automatic mode, two principles are generally used. Each of these principles relates to a technically different device but controlled each time by a rocking button with two positions. According to a first principle, an impulse of short duration on the rocking button controls the complete opening and closing of the window. According to another principle, using a double switch, for each position of the rocking button, a stronger force on this button permits selecting the automatic mode.

These two principles have drawbacks. In the first principle, an action on the pushbutton seeking, in the manual mode, to adjust the position of the window, can be interpreted by the control system or the window operator as an instruction in the automatic control mode. For the second principle, the quantity of effort to be exerted to carry out an action in the manual mode or in the automatic mode is not obvious for all users.

It should also be noted that for the two principles described above, the automatic mode does not permit having access to an intermediate position but solely to entirely open or entirely close positions of the window.

SUMMARY OF THE INVENTION

The present invention thus has for its object to provide a system for controlling a window operator, permitting having access more easily to the automatic mode and to the manual mode. Preferably, this system will permit, in the automatic mode, access to intermediate open positions. It will also preferably be more user friendly and ergonomic than the present systems.

To this end, the device which it provides is a control device for a window operator or the like, comprising a control means permitting controlling the opening and closing of an associated window. According to the invention, the control means has three separate control zones.

The present invention relates more particularly to electric window operators but can also relate to an electrically opening roof for example.

The fact of providing three separate control zones permits facilitating access to the manual and automatic modes. One or several zones can be reserved for the use of one of these modes. There can also be provided a zone permitting choosing an operation mode, automatic or manual, whilst the other zones thus permit controlling the raising and lowering of the corresponding window (or the like, which is to say for example opening and closing an openable roof).

To offer the greatest comfort of use and greatest flexibility of use, it can be provided that one control zone permits continuous control in the manner of a cursor. This embodiment is also ergonomic.

In a preferred embodiment of the control device, the control means is preferably constituted by a button sensitive to tactile control. In this embodiment, the sensitive button comprises for example two conductive zones reacting to the pressure of a finger of a user as well as a resistive zone, disposed between the two conductive zones, and reacting both to a push and also to a movement of a finger of a user.

In the case in which the control device comprises a button sensitive to tactile control, this latter preferably integrates, on a same support, control means of a separate device of the corresponding window opener. This control thus includes also a control device to carry out adjustment of the rearview mirrors.

To facilitate "blind" marking of the control device according to the invention, which is to say so that the user need not look, above all but not only when control is tactile, it can be provided that the control means has at at least one of its ends a raised flange. Tactile references (notches, groves, asperities, etc) can, as a supplement or replacement, be disposed on the control means itself.

For better ergonomics of the control device, the control zones are preferably aligned on a surface incurved on the arc of a circle or the like. Thus, the finger of a user can move over the three control regions without the corresponding palm of a hand having to move.

The present invention also relates to a control process for an electric window operator or the like with the help of a control circuit as described above.

According to this process, in the automatic mode, when the corresponding window has been entirely opened or closed, a push on a predetermined control zone causes the movement of the window into the position in which it was before its complete opening or closing.

This process thus permits providing an automatic mode with an intermediate position of the corresponding window (or opening roof for example). There is thus provided a function which is not present in any automotive vehicle sold at present.

This control process of an electric window operator or the like, according to the invention, in the case in which the control device comprises a control zone permitting a continuous control, preferably provides that an action on the control zone permitting continuous control, is used to carry out a manual adjustment of the position of the corresponding window whilst an action on the two other control zones of the control device is used to carry out an automatic adjustment of the position of this window.

BRIEF DESCRIPTION OF THE DRAWING

The details and advantages of the present invention will become better apparent from the description which follows, given with reference to the accompanying schematic drawing, in which.

DETAILED DESCRIPTION OF THE INVENTION

Figure 1:
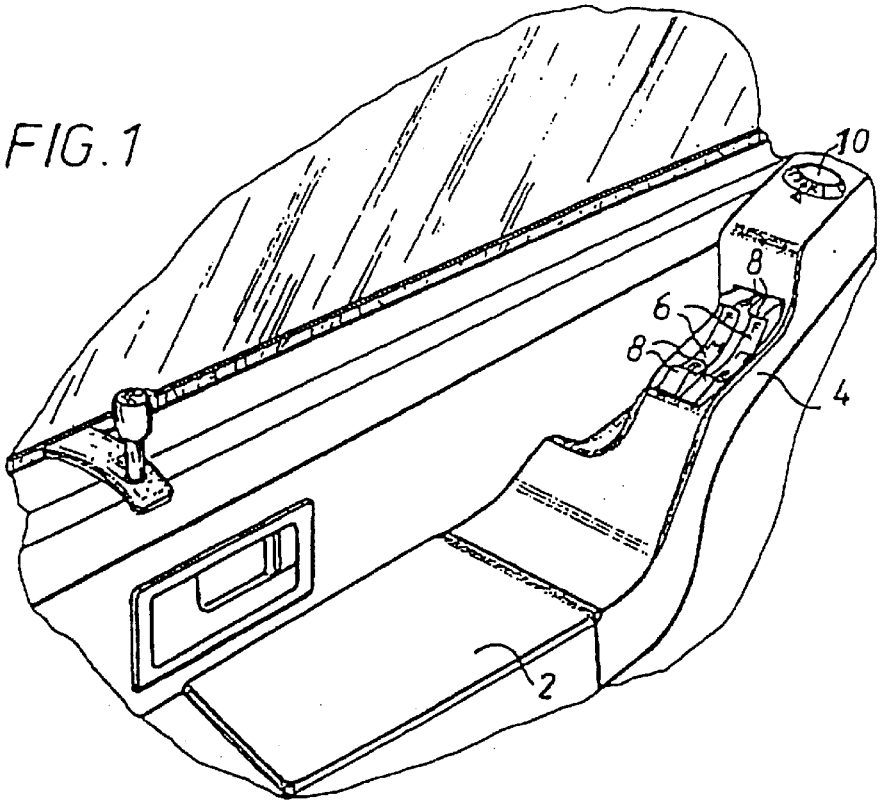
FIG. 1 is a perspective view of an automotive vehicle armrest comprising two control devices according to the present invention.
Figure 2:
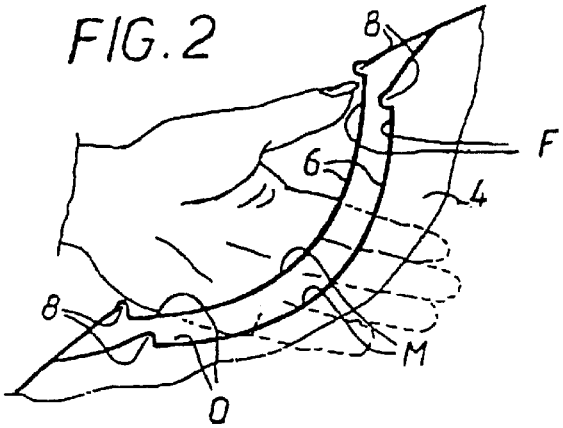
FIGS. 2 to 5 are side views of these control devices in various configurations of use.
Figure 3:
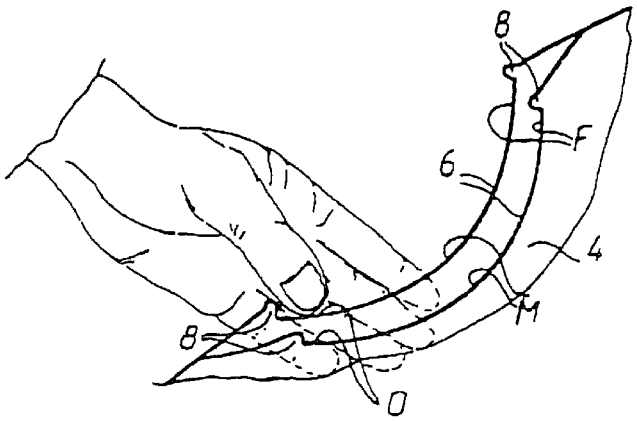
Figure 4:
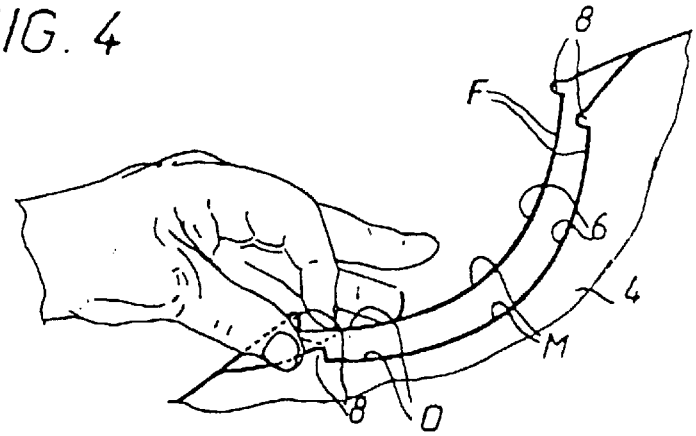
Figure 5:
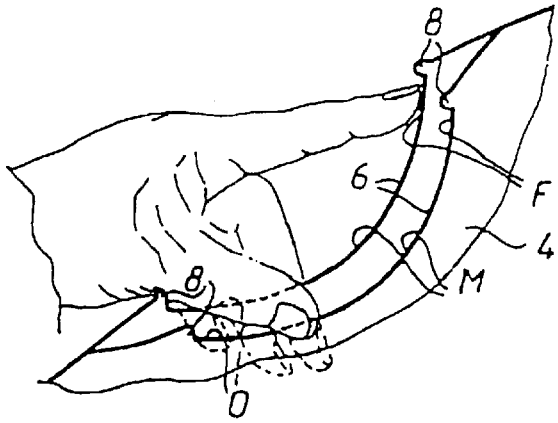

FIG. 1 shows an internal portion of an automotive vehicle door. Conventionally, this door comprises an armrest 2 which is prolonged by a handle 4. At the level of this handle are disposed two electric window operating controls 6. These two controls are identical. They are disposed side by side with a height offset such that a user can easily distinguish one control from the other without having to look. A space is left free between the door and the handle 4 to permit the passage of the fingers of the user which are not used for controlling the windows.

The controls 6 each have three actuating zones indicated in FIG. 1 by the letters F, M and O. As is seen particularly in FIGS. 1 to 5, the zones F, M and O are aligned along a concave strip having, seen from the side (FIGS. 2 to 5), substantially the shape of an arc of a circle. Thus, as shown in FIGS. 2 to 5, the thumb or index finger of a user can slide easily along the control 6. This control is located substantially in a vertical plane but so as even better to match the natural movement of the finger of the user, this control can be inclined toward the door.

The controls 6 comprise a sensitive button permitting the user to control a movement of the windows by simple touch. Such sensitive surfaces are known to those skilled in the art. They are generally constituted by two films on which are provided conductive tracks. The two films are disposed on each other, the conductive tracks facing each other. At rest, the two films are held at a distance from each other such that the conductive tracks do not touch. When a user touches the upper film, the conductive tracks come locally into contact with each other thereby closing an electric circuit. Such tactile controls are sensitive to point pressure of the finger of a user but may also be sensitive to a movement of this finger along the sensitive surface. In this case, at least one conductive track of a sensitive film comprises generally a resistive region. The principle of operation of such tactile controls is known to those skilled in the art and is not described here in greater detail.

Such tactile controls are integrated perfectly into the handle 4. They permit exactly matching the external surface of this handle such that there is no projection of these controls 6. So that the user can easily read the controls 6 without having to look at them, a raised flange 8 is provided at each end of the sensitive zone of the control 6, there can also be provided on the surface of each control 6 tactile references (notches, grooves, asperities, etc. . . . ).

As suggested in FIG. 1, the tactile film used to make the control 6 of the window operator can be prolonged so as to integrate 1) or several) other control or controls. In the case shown in FIG. 1, there could also be on the same tactile film the two controls for the window operator 6 and a control 10 for adjusting the rearview mirrors.

Figure 6:
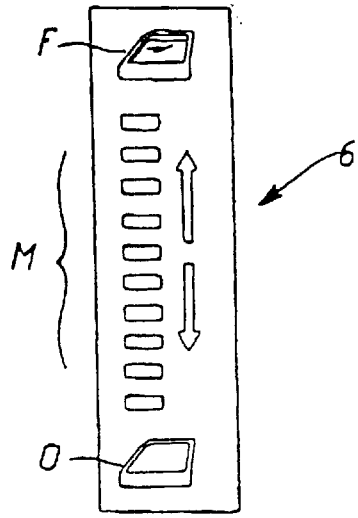
FIG. 6 is a top plan view of a modified embodiment of a control device.

FIG. 6 shows an example of serigraphy which could be used to dress the control 6. The designs shown on this serigraphy could be made in relief. There will be seen in this figure the three zones F, M and O of the control 6.

For window operator controls 6, there is provided in reference zones F and O a tactile control singularly by bearing, whilst at the level of the zone marked M, a displacement of the user finger is also taken into account. With such a structure, several principles of operation, after access to the automatic mode at an intermediate position of the corresponding window, are to be envisaged. Three processes for control of the window operator are described according to non-limiting examples.

In the present description, the operation in automatic mode means that an action of short duration takes place on the control device, permitting obtaining a predetermined window position, without the user having to act during movement of the window. In the manual mode, the window moves only when the user acts on the control device and stops as soon as the action of the user has been finished.

According to a first process, a push on the zone F permits, in the automatic mode, closing the corresponding window. Similarly, by bearing on the zone O, automatic opening of this window is permitted. When the glass is entirely open or closed, a new bearing on the zone O or F, respectively, gives rise to an automatic return to the position that the window had before being entirely open or entirely closed. The control device thus includes a function of memorization and an automatic access to the memorized position is carried out.

It can thus be provided that a further push, again in the same zone, before the arrival in position, immediately stops the movement of the window. If this push is carried out not in the zone F or O but in the zone M, the window also stops but the system then passes into the manual mode.

The zone M is thus used for control in the manual mode. When the user slides his finger in the M toward the zone F, he controls the raising of the window. When he withdraws his finger, the window automatically stops. Similarly, to lower the window, the user moves his finger located in the zone M toward the zone O. When the desired position of the window is obtained, the user withdraws his finger and the movement of the window stops. Thus, the user can adjust the position of the window in a functional manner equivalent to the manual manner existing at present in automobile windows. If the control is not thus used during a predetermined period of time, it can be provided that the system returns to automatic mode.

According to another process of operation, a push with the finger of the user on the zone F or the zone O causes the window respectively to raise or lower, corresponding to the manual mode.

The zone M permits automatic access to an intermediate position or to entirely open or closed positions of the window.

A movement of the finger of the user from the zone M to the zone F gives rise to the complete closing of the window. Similarly, a movement from the zone M toward the zone O gives rise to complete opening of the window.

Thus, to return to the intermediate position in which the window is located before being completely open or completely closed, the user carries out a reverse movement, that is, from the zone O or F toward the central zone M.

According to the third process described here, an impulse in one of the zones F, O or M gives rise to operation in automatic mode. A push in the zone F or O gives rise respectively to closing or complete opening of the window whilst a push in the zone M gives rise to a raising or lowering of the window to a position which is proportional to the position of the location where the impulse in zone M was carried out.

The manual mode is obtained, using an upward or downward movement of the base on the control.

When the window is in an extreme position, a push on the corresponding zone F or O gives rise to the return, in automatic mode, to the position that the glass had before reaching its entirely open or entirely closed position.

As shown by the preceding examples, the present invention permits carrying out an ergonomic control of a window operator. The user no longer need calibrate the force or duration of a push on a button to pass from manual mode or automatic mode. Moreover, the automatic mode permits access to an intermediate position.

The access to an intermediate position in the automatic mode permits for example after passes through a tollbooth, and hence with complete opening of the driver's window, returning to the position of opening of the window before arrival at the booth. Similarly, after stopping for a short duration, during which the windows will be closed, it is possible to resume automatically the opening of the window as it was before stopping.

The form of the controls described is also ergonomic. The user can easily find the control of the window operator without taking his eyes off the road. Moreover, the shape of the controls permits the thumb or index finger of the user to move upon this command without having to move the palm of the corresponding hand.

The present invention is not limited to the embodiments described above by way of non-limiting example. It also relates to modified embodiments within the scope of those skilled in the art.

Thus, for example, the control of the window operator could be carried out not with the help of a surface sensitive to tactile control, but by a control having three separate zones. One zone could for example be provided with a roller with a path that is limited or not, as is found for example on a computer mouse.

The processes described are given solely by way of example and are not limiting. Other processes, particularly for controls not having zones reacting to a movement of the finger of the user, could be envisaged without departing from the scope of the invention.

The ergonomic shape in an arc of a circle of the control corresponds to a preferred embodiment. Other shapes are of course envisageable. The control could be carried out flat or else, in lieu of having a concave shape, it could also have a convex shape.

The control as described is located at the level of a handle of an automotive vehicle door. A similar control could however be found at the level of a central console, of, a dashboard or an overhead control for an electrically opening roof.

What is claimed is:

1. A control device for controlling a window operator, comprising control means (6) permitting controlling the opening and closing of an associated window, characterized in that the control means has three zones (F, M, O) of separate control, the control means having an automatic mode, when the corresponding window has been entirely opened or closed, a push on a predetermined control zone controls the movement of the window into the position in which the window was before its complete opening or closing.

2. Control device according to claim 1, characterized in that a control zone (M) permits continuous control.

3. Control device according to claim 1, characterized in that the control means (6) is constituted by a button sensitive to tactile control.

4. Control device according to claim 3, characterized in that the sensitive button comprises two conductive zones (O, F) reacting to the pressure of a finger of a user as well as a resistive zone (M), disposed between the two conductive zones, and reacting both to a push and also a movement of a finger of a user.

5. Control device according to claim 3, characterized in that the sensitive button with tactile control includes, on a same support, control means (10) of a device separate from the corresponding window operator.

6. Control device according to claim 1, characterized in that the control means has at least one of its ends a raised flange (8).

7. Control device according to claim 1, characterized in that the control zones (F, N, O) are aligned on a concave surface on an arc of a circle.

8. Process for controlling an electric window operator with a control device having a control means (6) permitting controlling the opening and closing of an associated window, the control means having three zones (F, M, O) of separate control and in that in automatic mode, when the corresponding window has been entirely opened or closed, a push on a predetermined control zone controls the movement of the window into the position in which the window was before its complete opening or closing.

9. Process for controlling an electric window operator according to claim 8, in which a control zone permits continuous control, characterized in that an action on the control zone permitting continuous control is used to carry out manual adjustment of the position of the corresponding window whilst an action on the two other control zones of the control device is used to carry out automatic adjustment of the position of this window.

10. Control device according to claim 2, characterized in that the control means (6) is constituted by a button sensitive to tactile control.

11. Control device according to claim 4, characterized in that the sensitive button with tactile control includes, on a same support, control means (10) of a device separate from the corresponding window operator.

12. Control device of claim 1, in which a control zone permits continuous control, characterized in that an action on the control zone permitting continuous control is used to carry out manual adjustment of the position of the corresponding window whilst an action on the two other control zones of the control device is used to carry out automatic adjustment of the position of this window.

* * * * *